US009295366B2

(12) United States Patent
Pearlstein

(10) Patent No.: US 9,295,366 B2
(45) Date of Patent: Mar. 29, 2016

(54) ROTARY CLEANING HEAD HAVING INDIRECT FLUID APPLICATION

(71) Applicant: Keith Stewart, Vernal, UT (US)

(72) Inventor: Dennis Pearlstein, Austin, TX (US)

(73) Assignee: Keith Stewart, Vernal, UT (US)

( * ) Notice: Subject to any disclaimer, the term of this patent is extended or adjusted under 35 U.S.C. 154(b) by 151 days.

(21) Appl. No.: 14/188,135

(22) Filed: Feb. 24, 2014

(65) Prior Publication Data

US 2014/0245559 A1 Sep. 4, 2014

Related U.S. Application Data

(63) Continuation of application No. 13/900,419, filed on May 22, 2013, now abandoned, which is a continuation of application No. 11/641,274, filed on Dec. 18, 2006, now abandoned.

(51) Int. Cl.
*A47L 11/34* (2006.01)
*A47L 11/40* (2006.01)

(52) U.S. Cl.
CPC ..... *A47L 11/34* (2013.01); *A47L 11/4038* (2013.01)

(58) Field of Classification Search
CPC ..... A47L 11/34; A47L 11/4038
USPC ..... 15/320, 322
IPC ..... A47L 11/34
See application file for complete search history.

(56) References Cited

U.S. PATENT DOCUMENTS 2,168,692 A * 8/1939 Vidal ..... A47L 11/30 15/180

FOREIGN PATENT DOCUMENTS

GB 2217831 * 3/1992

* cited by examiner

*Primary Examiner* — David Redding
(74) *Attorney, Agent, or Firm* — Maschoff Brennan

(57) ABSTRACT

A rotary cleaning device having a plurality of flush pad extractors can provide improved debris removal and reduced residual material. More specifically, a rotary cleaning device can include a plurality of flush pad extractors which are oriented generally circumferentially about a common rotation axis. These unique flush pad extractors can include a fluid applicator and a vacuum member oriented behind the fluid applicator such that during operation of the device the fluid applicator contacts a surface to be cleaned prior to contact by the vacuum member. In accordance with the present invention, the fluid applicator provides passive delivery of fluid to the surface to be cleaned. Passive delivery of fluid allows for reduced fluid usage and more controlled and even distribution of fluid across a surface without overwetting.

20 Claims, 9 Drawing Sheets

46
69
44
28
68
65
64
46
31
30
46
48
41
61
62
63
34
70
68

71
68

66
67
70 scrubber hsg. omitted for clarity

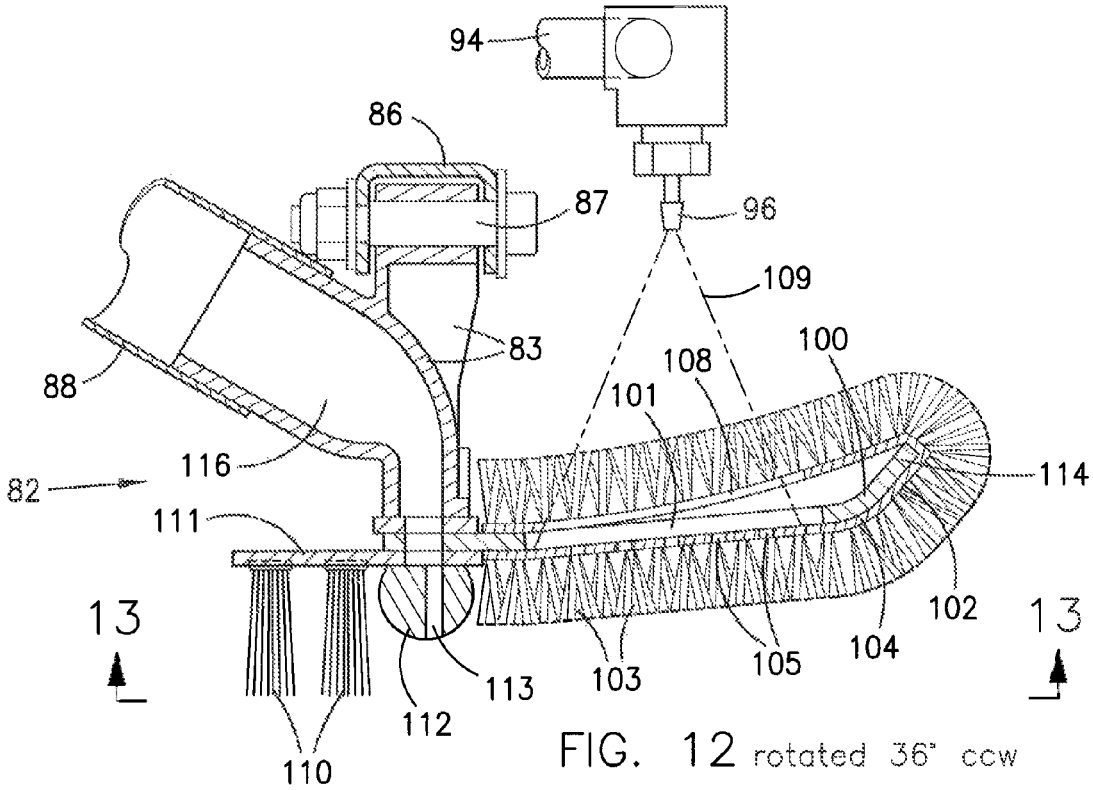
FIG. 12 rotated 36° ccw
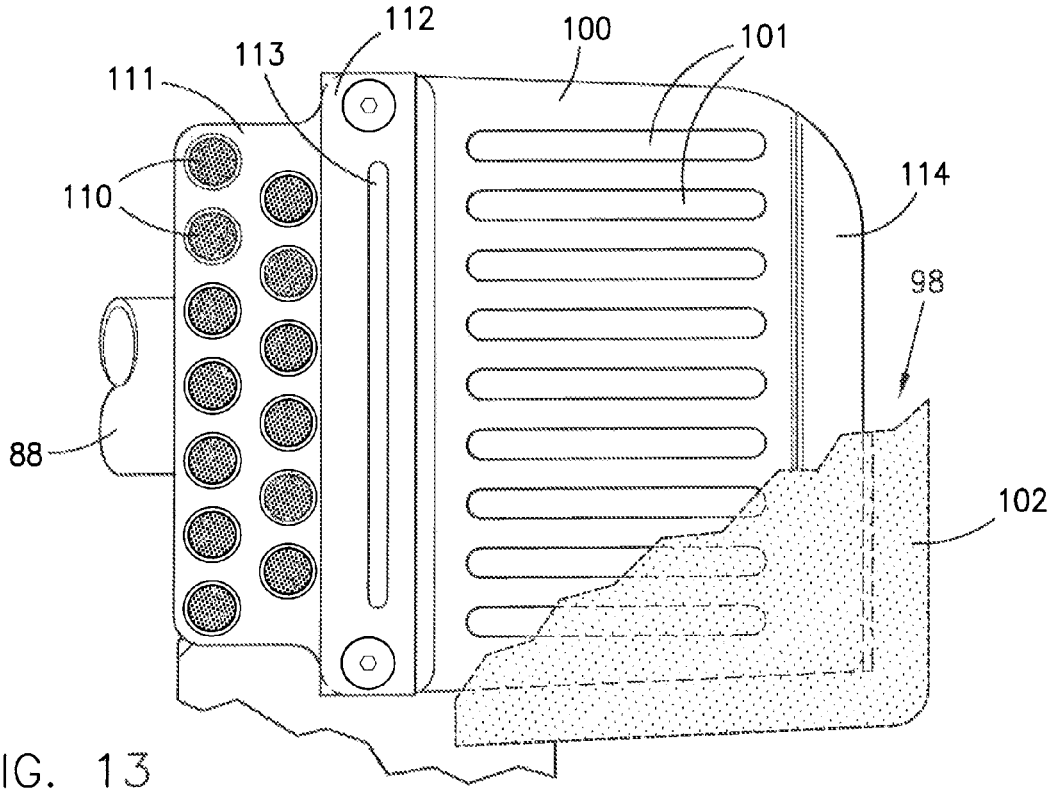
FIG. 13

ROTARY CLEANING HEAD HAVING INDIRECT FLUID APPLICATION

RELATED APPLICATION

This application is a continuation of U.S. patent application Ser. No. 13/900,419, filed May 22, 2013, which is a continuation of U.S. patent application Ser. No. 11/641,274, filed on Dec. 18, 2006, the content of which is incorporated by reference in its entirety.

BACKGROUND

1. Field of the Invention

The present invention relates generally to cleaning of flooring materials such as carpet. More specifically, the present invention relates to rotary soil extraction devices. Accordingly, the present invention involves the fields of cleaning and carpet cleaning and treatment.

2. State of the Art

Thorough removal of debris from various flooring materials such as carpet can be a challenging task. Dry vacuuming can remove a portion of debris such as soil, etc.; however, a large portion of such material remains embedded within carpet fibers. A wide variety of mechanisms have been developed to provide additional cleaning such as shampoo processes, steam cleaning, soil absorption such as bonnet cleaning, soil extraction such as chemical cleaning done by ChemDry and others, host cleaning where a particulate cleaning agent is dispersed and then vacuumed, and encapsulation using a crystalline cleaning agent. Each of these processes provides benefits ranging from cost, well established performance and market, and simplicity. However, most, if not all, current approaches within each area also suffer from various drawbacks such as excess water, extended dry times, chemical residue build-up, and/or poor soil removal.

Conventional wisdom in cleaning carpets is to clean deep and penetrate the carpet fibers to remove soil and debris. However, this often leaves excessive water remaining in the carpet which results in extended dry times. Further, chemical treatments typically leave at least a portion of the chemical in the carpet, often resulting in unacceptable residue build-up over time. Most chemical treatments are limited to cleaning the top quarter portion of the carpet piles, leaving the remainder substantially uncleaned. Some shampoo treatments and steam cleaning processes clean deeper into the carpet pile, but leave substantial amounts of water which can take as much as twelve hours or more to completely dry.

As such, improved processes and systems which can be used to enhance deep cleaning of flooring materials such as carpet without leaving excessive water or chemical residue, and which are also economic, continue to be sought through ongoing development efforts.

SUMMARY OF THE INVENTION

In accordance with the present invention, a rotary cleaning device having a plurality of flush pad extractors can provide improved debris removal and reduced residual material. More specifically, a rotary cleaning device can include a plurality of flush pad extractors which are oriented generally circumferentially about a common rotation axis. These unique flush pad extractors can include a fluid applicator and a vacuum member oriented behind the fluid applicator such that during operation of the device the fluid applicator contacts a surface to be cleaned prior to contact by the vacuum member. In accordance with the present invention, the fluid applicator can provide passive delivery of fluid to the surface to be cleaned. In a more detailed aspect of the present invention, a retrofit kit can include a plurality of flush pad extractors which are adapted for insertion into a rotary cleaning head device.

There have thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

BRIEF DESCRIPTION OF THE DRAWINGS

FIG. 12 is a fragmentary vertical section of a flush pad extractor and attachment to a rotary cleaning head taken in the line 12-12 of FIG. 11.

FIG. 13 is a fragmentary bottom partial cut-away view of the flush pad extractor looking from the line 13-13 of FIG. 12.

Figure 1:
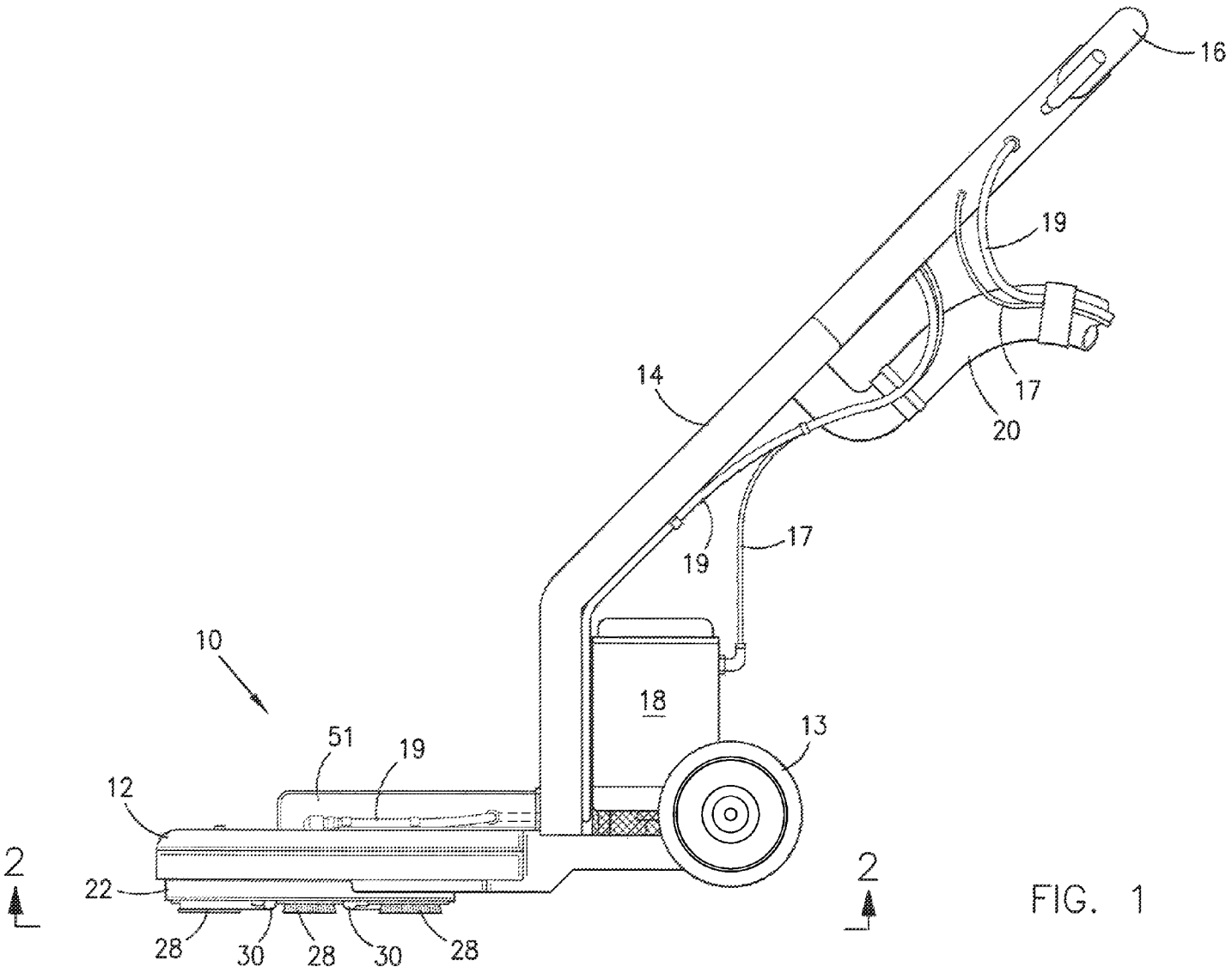
FIG. 1 is a side elevation of a rotary cleaning apparatus having a rotary cleaning head in accordance with one embodiment of the present invention.

The drawings will be described further in connection with the following detailed description. Further, these drawings are not necessarily to scale and are by way of illustration only such that dimensions and geometries can vary from those illustrated.

DETAILED DESCRIPTION OF THE ILLUSTRATED EMBODIMENTS

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an," and "the" include plural referents unless the context clearly dictates otherwise. Thus, for example, reference to "a head" includes one or more of such structures, reference to "a vacuum slot" includes reference to one or more of such features and reference to "a cleaning cycle" includes reference to one or more of such steps.

DEFINITIONS

In describing and claiming the present invention, the following terminology will be used in accordance with the definitions set forth below.

As used herein, "passive delivery" of fluid refers to indirect or contact delivery or transfer of a fluid to a surface. Passive delivery of a fluid involves application of a fluid by direct contact of a fluid applicator to a surface. Generally, fluid flows from the fluid applicator to the surface, such as the carpet, via a portion of the fluid applicator such as flexible bristles or tufts. In contrast, active or direct delivery includes pressurized spraying or depositing of a fluid directly on the surface such as the carpet, without an intermediate material. Thus, passive delivery occurs substantially free of fluid pressure or velocity of the fluid into the carpet.

As used herein, "immediately" refers to a spatial relationship which is either direct contact or sufficiently close so as to provide substantially no space or delay between the identified members.

As used herein, "vacuum" refers to a condition of reduced pressure sufficient to cause a suction effect for removal of material from a surface. Thus, the term vacuum is not solely limited to low pressures associated with an environmental vacuum, e.g. less than $10^{-5}$ torr.

As used herein, "metallic" refers to a metal, or an alloy of two or more metals. A wide variety of metallic materials are known to those skilled in the art, such as iron, steel, stainless steel, aluminum, copper, chromium, titanium, tungsten, zinc, etc., including alloys and compounds thereof.

As used herein, "substantial" when used in reference to a quantity or amount of a material, or a specific characteristic thereof, refers to an amount that is sufficient to provide an effect that the material or characteristic was intended to provide. The exact degree of deviation allowable may in some cases depend on the specific context. Similarly, "substantially free of" or the like refers to the lack of an identified element. Particularly, elements that are identified as being "substantially free of" are either completely absent, or are included so as to have no measurable effect on the invention.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. As a non-limiting example of this principle, artificial turf and bonnet material can be suitable fluid applicator materials. However, artificial turf is non-absorbent, while bonnet material is highly absorbent. Absorbency of a material can affect suitability for a particular application. It is not the purpose of this specification to exhaustively outline every possible distinction among potentially useful components, but rather to illustrate the principles of the present invention, often with the use of such lists.

Dimensions, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

Rotary Cleaning Devices

In accordance with the present invention, a rotary cleaning device 10 is shown in FIG. 1 including a base housing member 12, wheels 13, and an upper control member 14. The base housing member 12 houses or otherwise retains a rotary cleaning head 22 in accordance with the present invention. The upper control member 14 is used to manipulate, maneuver, and control the device during operation by grasping the handle 16. The upper control member 14 can optionally include controls such as buttons or levers for adjusting motor speed, controlling the vacuum, and/or controlling the fluid application rate. An electrical connection 17 can be operatively connected to the upper control member and the motor. Further, a water supply line 19 can be fluidly connected to the rotary cleaning head as described in more detail below. No particular limitation is intended with the illustrated configuration such that the basic upper control member and housing member mechanisms can be either designed and fabricated or may be obtained from existing rotary cleaning suppliers. As a general matter, the rotary cleaning device can include a motor 18 for driving the rotary cleaning head and a vacuum outlet 20 for removing liquid and debris recovered from a flooring surface. The present invention is particularly directed toward the rotary cleaning head 22 housed within or otherwise supported by the base housing member 12 as described in more detail below.

Figure 2:
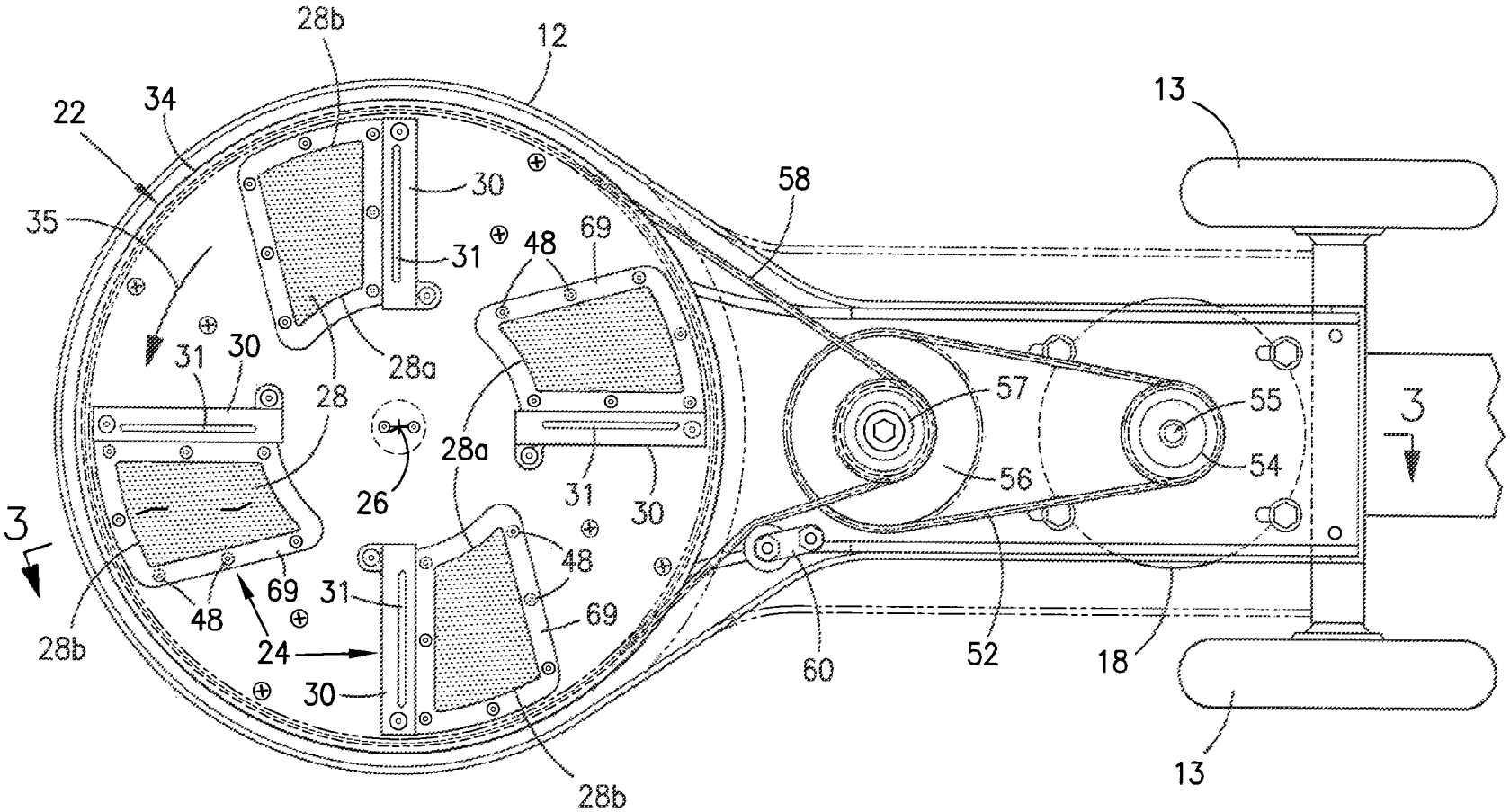
FIG. 2 is a bottom plan view of the embodiment of FIG. 1 looking from the line 2-2 of FIG. 1.
Figure 3:
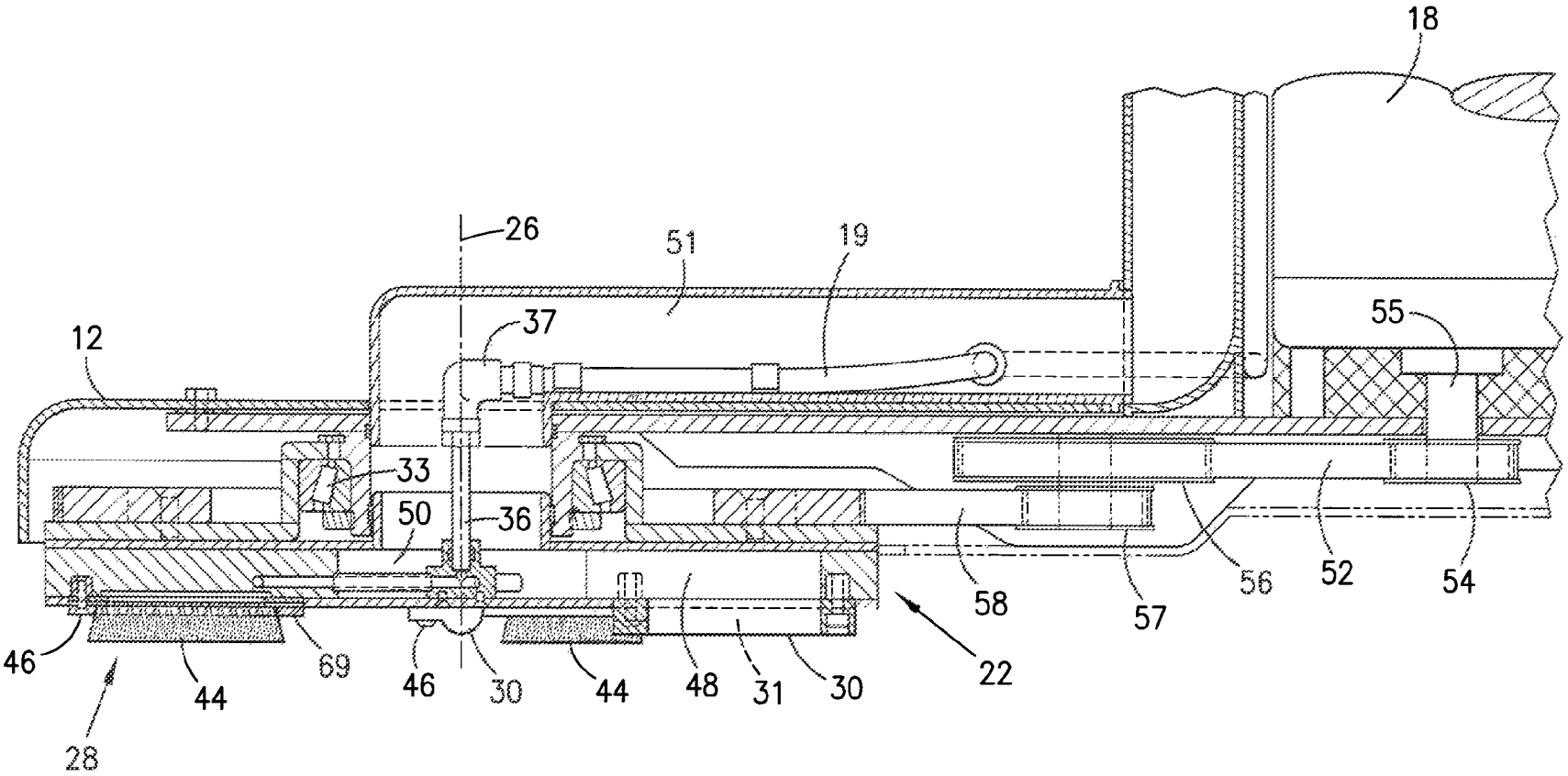
FIG. 3 is a vertical section taken on the line 3-3 of FIG. 2.

FIG. 2 illustrates a rotary cleaning head 22 in accordance with one embodiment of the present invention. A plurality of flush pad extractors 24 can be oriented generally circumferentially about a common rotation axis 26. Any number of flush pad extractors 24 can be oriented on the rotary cleaning head; however, as a practical matter two to six flush pad extractors are typically effective, four being shown. The flush pad extractors can include a fluid applicator 28 and a vacuum member 30 with vacuum slot 31 forming a vacuum opening oriented behind the fluid applicator such that during operation of the device, the fluid applicator 28 contacts a surface to be cleaned prior to contact by the vacuum member 30. In this way, the fluid applicator 28 can provide passive delivery of fluid to the surface to be cleaned, with the fluid applied then being removed from the surface by the vacuum member 30 through vacuum slot 31. The embodiment illustrated in FIG. 2 shows a rotatable disk 34 on which flush pad extractors 24 are oriented for counterclockwise operation with respect to the bottom view of FIG. 2, as shown by arrow 35.

The vacuum member 30 can be oriented immediately behind the fluid applicator as illustrated in FIG. 2. Although each set of a vacuum member 30 and fluid applicator 28 can be mounted adjacent, i.e. contacting, to one another, this is not required. For example, the fluid applicator 28 can be mounted such that a space exists between the applicator 28 and the vacuum member 30. However, it can often be preferable to mount the vacuum member 30 and fluid applicator 28 substantially adjacent one another in order to reduce residence time of fluid on the flooring surface.

The fluid applicator 28 provides indirect application of a cleaning fluid to a flooring surface. In one embodiment of the present invention, this can be accomplished by forming the fluid applicator at least partially from a non-absorbent agitating pad. The non-absorbent agitating pad can be any material which does not substantially absorb foreign debris and dirt from the carpet. This allows for an increased useful life over absorbent materials which can require frequent replacement and/or cleaning. Suitable non-limiting examples of non-absorbent agitating materials can include artificial turf or other bristled or porous materials which are resilient and non-absorbent. Standard brush bristles tend to be non-absorbent; however, their use as the fluid applicator is generally unsatisfactory. Specifically, conventional brushes have a bristle spacing and shape which allows for excessive fluid application to the carpet and can easily result in overwetting and uneven distribution of fluid. Thus, suitable non-absorbent agitating material should preferably provide resilient agitation as well as retain fluid sufficient to prevent overwetting.

In another optional embodiment, suitable fluid applicator materials can include microfibers, bonnets, absorbent cloth with abrasive strips, etc. These materials can be beneficial where the carpet is fragile or otherwise requires more delicate treatment. For many applications however, the aggressive artificial turf or similar non-absorbent agitating materials can provide improved cleaning action per pass and significantly increased useful life of the pads. In still another optional embodiment, one or more of the fluid applicator materials can include a composite material which includes both absorbent and non-absorbent portions. Specifically, a non-absorbent bristle material can be incorporated into an absorbent bonnet material as strips or other embedded regions. Although many configurations are possible, one commercially available composite material includes the Q810 Commercial Scrubber pad by Rubbermaid®. Further, a combination of various non-absorbent and absorbent agitating materials can be used, e.g., every other fluid applicator can alternate non-absorbent, absorbent, etc.

Regardless of the specific fluid applicator material chosen for use in a particular embodiment, the cleaning fluid can be delivered through the fluid applicator material. This indirect fluid application process provides increased control over the fluid delivery rate and prevents direct jetting of fluid onto the flooring material which can cause excessive penetration of the fluid into flooring materials such as carpet.

Additional optional features can also be included on the rotary cleaning head 22. Depending on the spacing of the flush pad extractors 24, optional support buffers (not shown) can be oriented between the flush pad extractors. Support buffers can more evenly distribute weight across the rotating disk 34 and can increase smoothness of operation. In another optional embodiment, at least one of the flush pad extractors can further include an agitating brush immediately after the vacuum member 30 opposite the fluid applicator 28. The agitating brush can include bristles which act as an aggressive tool to dislodge debris from flooring surfaces. In yet another optional embodiment, additional vacuum members can be added between flush pad extractors. These additional vacuum members can help to further reduce excess fluid from a flooring surface.

Alternatively, the flush pad extractor can include a fluid applicator and a vacuum member which are spaced apart. For example, depending on the number of flush pad extractors, the vacuum member and fluid applicator can be circumferentially spaced apart from about 10° to about 90°, and in some cases from about 15° to about 45° apart about the rotary cleaning head. Although some spacing between the fluid applicator and vacuum member is allowable, this spacing is generally suitable as long as the rotation rate of the rotary cleaning head is sufficient to prevent the fluid supplied by the fluid applicator from penetrating excessively into the carpet or other flooring surface, e.g., over half way through the flooring material, before being removed by the vacuum member.

Further, although the fluid applicators 28 are shown having arcuate inner and outer ends 28*a* and 28*b*, respectively, with the radius of the respective arcs being the distance from the center 26 of the rotating cleaning head 22 to the respective end, this is not required. The fluid applicators can be rectangular, trapezoidal, polygonal, triangular, circular, or any other functional shape. Different shapes can allow for variation of scrubbing time and can affect the fluid application rate by increasing or decreasing surface area of the fluid applicators. The illustrated shape, with outer arcuate end 28*b* longer than inner arcuate end 28*a* so that the width of the fluid applicator 28 increases as it extends further from the center of the cleaning head, compensates for the difference in the speed of the fluid applicator as it travels over the carpet during rotation of cleaning head 22. It should be noted that with a rotating disc, the further from the center of rotation, the faster the speed of travel of a point on the disc. With the illustrated increase in width of the fluid applicator, each portion of the carpet in contact with the fluid applicator 28 during a rotation of the cleaning head 22 receives substantially the same contact time and same fluid application.

Figure 4:
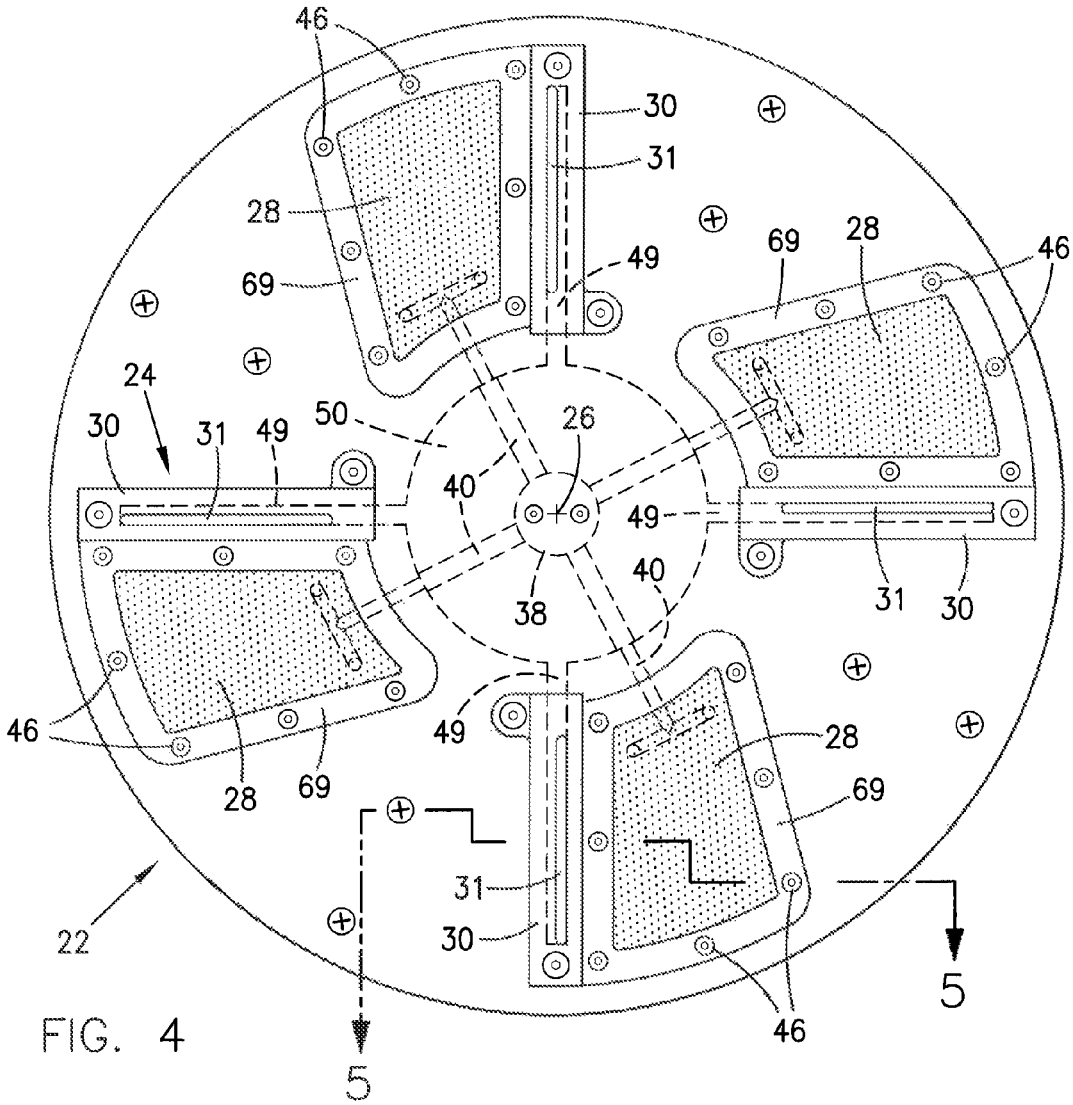
FIG. 4 is a bottom plan view of the rotary cleaning head shown in FIG. 1, drawn to a larger scale and separated from the remainder of the cleaning apparatus.

Similarly to the fluid applicators, the vacuum members 30 can be oriented and/or configured in a variety of ways. Almost any functional shape of the vacuum member can be useful. The vacuum member can have slotted, circular, elliptical, or other shaped openings. Specifically, the vacuum members 30 can be straight with straight slots 31 as shown in FIGS. 2 and 4. However, the vacuum members can also be angled outward such that a radially outer-most portion of the vacuum member vacuum slot can be extended behind the position illustrated, i.e., further behind the outer end of the fluid applicator than the inner end. Such a configuration can provide substantially the same delay time between application of the fluid by the fluid applicator and vacuuming away of the fluid by the vacuum member, regardless of the distance from the center of the rotary cleaning head. However, the compensation for time between application and vacuuming away of the fluid has been found not to be as significant as compensation for application time of the fluid. In an additional optional embodiment, vacuum members and vacuum slots can be mounted in a position which is stationary with respect to the rotary cleaning head 22. For example, one or more vacuum slots can be mounted on the rotary cleaning device and oriented toward the flooring surface just outside the circumference of the rotary cleaning head, e.g. preferably on each of the left and right sides with respect to a person operating the device or on each of the forward and rearward sides with respect to a person operating the device. Such positioning eliminates the need for a rotary vacuum connection.

In yet an additional alternative embodiment, the number of flush pad extractor and/or fluid applicators can be varied. Specifically, the illustrated embodiments include four flush pad extractors; however, any functional number can be used.

For example, in many applications three flush pad extractor units can provide sufficient performance. Alternatively, five or more flush pad extractor units can also be mounted. In yet another alternative, one or more of the flush pad extractors can be configured to rotate in one or more sub-rotating disks or assemblies within the primary rotating disk.

Referring now to FIGS. 2-6, the rotary cleaning head 22 can be housed within the base housing member 12. The rotary cleaning head can be rotatably connected to the housing member in any functional manner. Non-limiting examples of rotating connections can include bearing connectors (e.g. ball bearing, cylinder bearing, etc.). In one embodiment, the connection can include a set of tapered roller bearings 33 which can be tilted toward the rotation axis 26 at their upper ends. This particular configuration can be beneficial in compensating for the rotating downward force due to the weight of the rotary cleaning head during operation. A cleaning fluid inlet line 36 can be operatively connected to each of the flush pad extractors 24. The fluid inlet line can be operatively connected to a cleaning fluid source via a connector 37 and a cleaning fluid supply line 19. In accordance with the present invention, a variety of cleaning fluids can be used. However, as a general matter the present invention allows for exceptional results using substantially only water as the cleaning fluid. Thus, in one embodiment of the present invention, the cleaning fluid can consist essentially of water. In the embodiment of FIGS. 2-6, the fluid inlet line 36 is connected to a central distribution area 38 having individual fluid lines 40 to each fluid applicator 28. The central distribution area can be a journal sealed rotary multi-connector 39 or any other functional fluid connector which allows for distribution of fluid to multiple flush pad extractors. As shown, fluid lines 40 connect the central distribution area 38 with respective reservoir areas 41 above each fluid applicator 28. Cleaning fluid is then distributed across the top side of the fluid applicator. While reservoir area 41 is shown, the cleaning fluid can be distributed across the fluid applicator using a network of lines, other reservoir configurations, pressurized spray nozzles, or any other suitable mechanism. In some cases, pressurized spray nozzles can be useful in evenly distributing fluid across the fluid applicator. Such spray nozzles can be oriented above the top side of the fluid applicator such that sprayed fluid is distributed thereon. The spray should not be directed so that the cleaning fluid is sprayed directly onto the flooring material.

Figure 5:
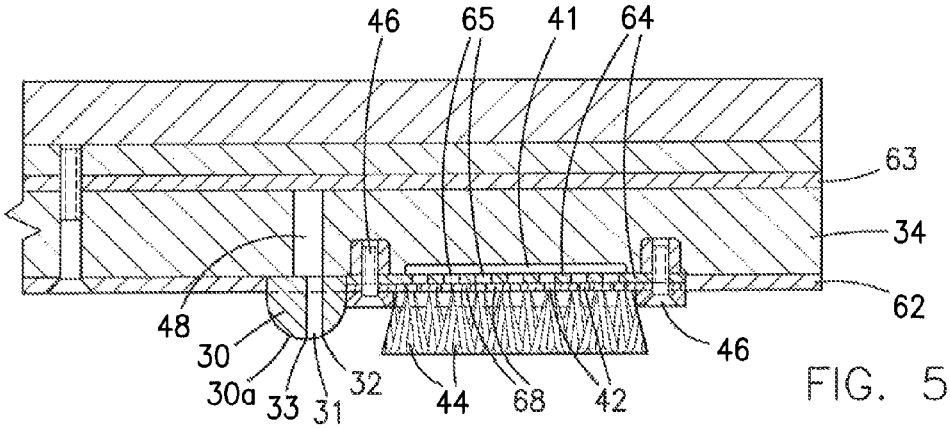
FIG. 5 is a fragmentary vertical section taken on the line 5-5 of FIG. 4, and drawn to a larger scale.
Figure 6:
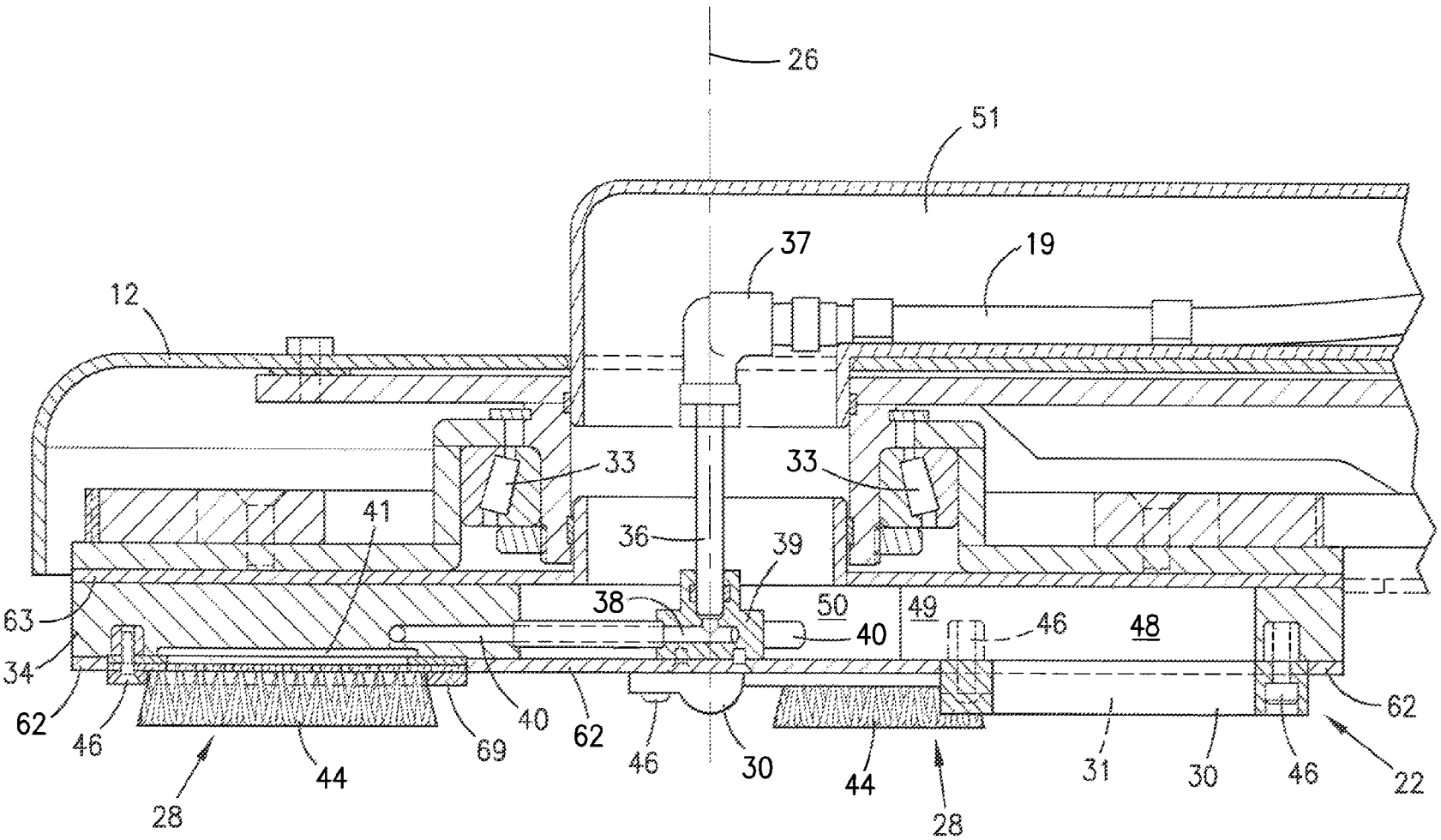
FIG. 6 is and enlarged view of the left end portion of FIG. 3.

The fluid applicator 28 can include perforations 42, FIG. 5, such as drilled holes or can be sufficiently porous to allow the cleaning fluid to pass from the top side to the bottom portion where an agitating material 44 can be located. The fluid applicators 28 and vacuum members 30 can each be secured using screws 46, as shown. Alternatively, the fluid applicators 28 and vacuum members 30 can be secured using slots, snaps, latches, and/or other mechanisms which allow for easy replacement once the part is worn or damaged. Each vacuum member is oriented adjacent a vacuum chamber 48 in communication with vacuum slot 31 which is configured to allow removal of solid and fluid debris from the flooring material through vacuum slot 31 and the vacuum system in communication therewith for collection and disposal.

The rotary cleaning head 22 of the present invention can be rotated using any mechanism which allows for rotation of the head about the rotation axis 26. Non-limiting examples of suitable rotation mechanisms can include belt drives, gear drives, direct drives, and the like. FIG. 2 illustrates a belt drive where a first belt 52 extends around a primary drive wheel or pulley 54. The primary drive wheel or pulley 54 is axially connected to the output shaft 55 of a motor 18, see FIG. 3. The first belt also encompasses a secondary drive wheel or pulley 56 to cause rotation of the secondary drive wheel or pulley 56. The secondary drive wheel or pulley 56 includes a further coaxial drive pulley portion 57. A second belt 58 extends around drive pulley portion 57 of secondary drive wheel or pulley 56 and encompasses a belt groove extending circumferentially around the rotary cleaning head 22. The primary and secondary pulleys are arranged to form a reducing transmission to rotate the rotary cleaning head more slowly than the rotation rate of the motor 18 to which the primary pulley 54 is connected. In operation, the motor 18 rotates at a speed sufficient to cause rotary cleaning head 22 to rotate at a desired rate about the rotation axis 26. In operation it can be desirable to provide for a speed of rotation of cleaning head 22 of about 100 rpm to about 180 rpm, although other speeds can also be functional. A standard belt tightener 60 can optionally be included to allow tension adjustment for belt 58 and/or belt removal.

Figures 7, 8, 9:
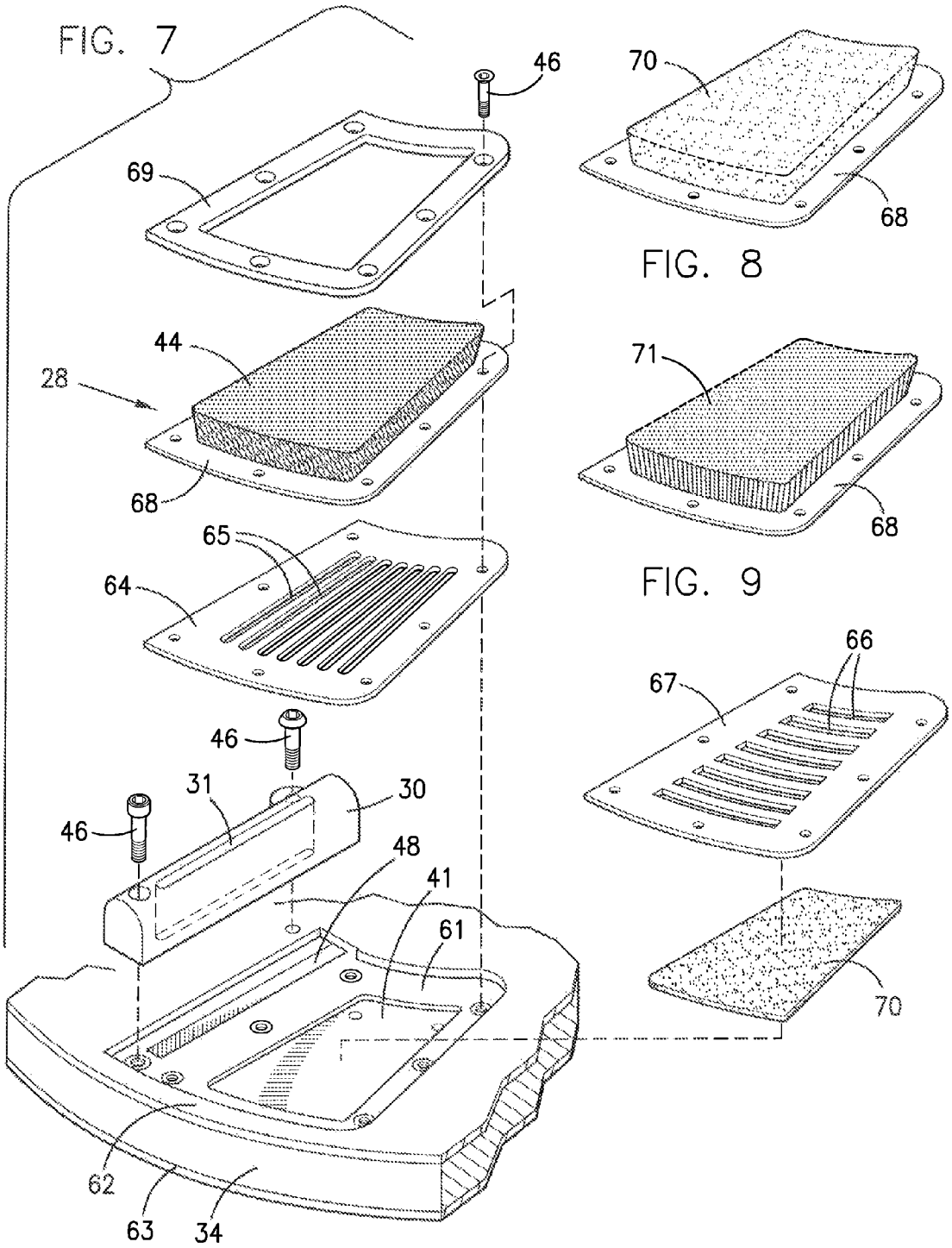
FIG. 7 is an exploded perspective view of a flush pad extractor and its attachment to a rotary cleaning head in accordance with another embodiment of the present invention.
FIG. 8 is a perspective view of an alternate embodiment of pad agitating material usable with the flush pad extractor of FIG. 7.
FIG. 9 is a perspective view of a further alternate embodiment of pad agitating material usable with the flush pad extractor of FIG. 7.
Figure 10:
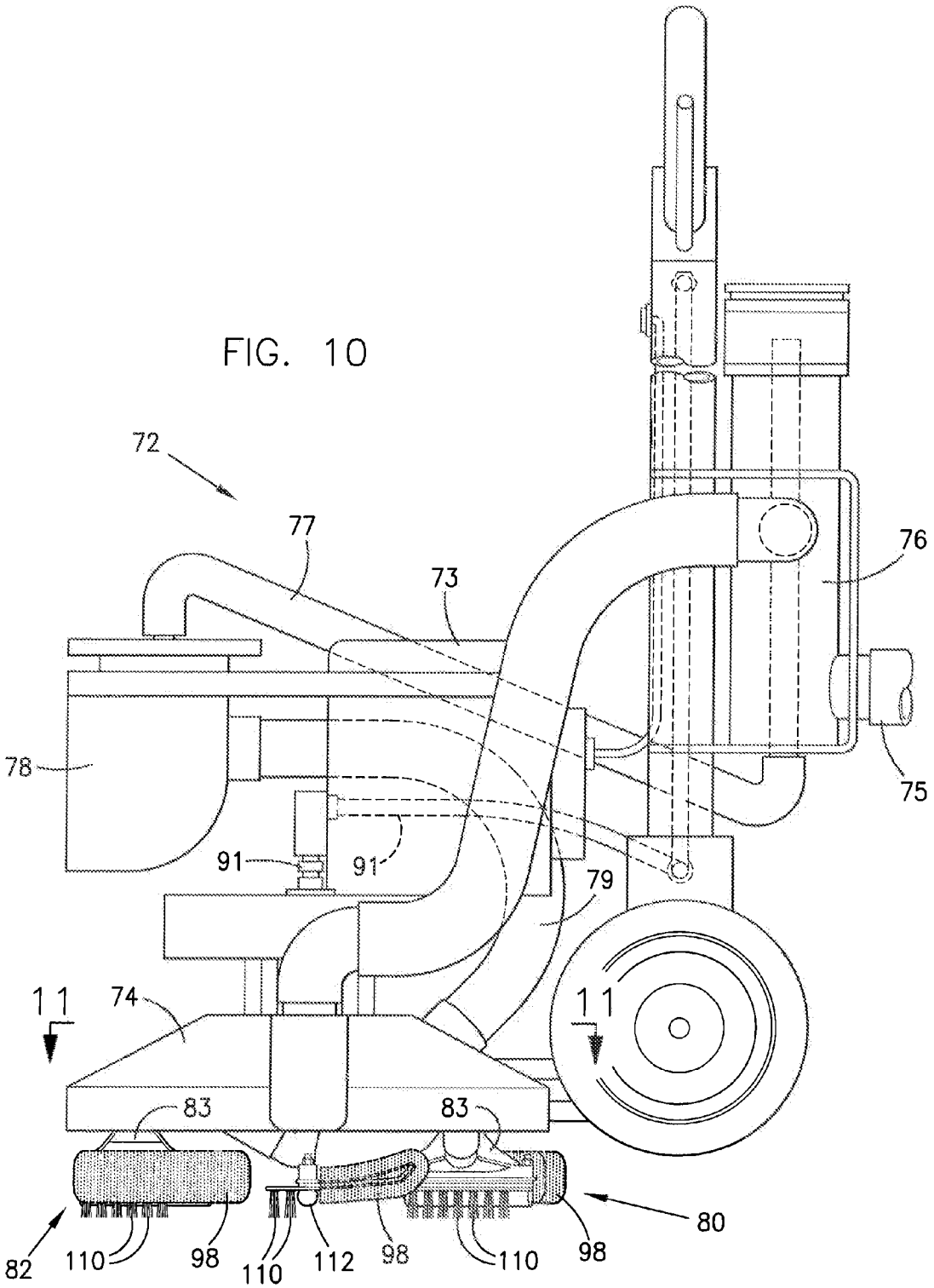
FIG. 10 is a side elevation of a rotary cleaning apparatus in accordance with another embodiment of the present invention.

FIG. 7 illustrates one alternative embodiment for integration of a flush pad extractor into a rotatable disk 34. Reservoir areas 41 and vacuum chambers 48 can be machined or molded into disk 34, with cut out area 61 in bottom disk plate 62 secured to the bottom of disk 34 (bottom in normal use orientation as in FIG. 1) forming a recess having a size sufficient to allow placement therein of a vacuum member 30 over a vacuum chamber 48 and a fluid applicator 28 over a fluid reservoir area 41. The flush pad extractor includes a distribution plate 64 having longitudinal slots 65 arranged therein to allow passage of fluid across the distribution plate 64, and through the distribution plate slots 65, to the fluid applicator 28. While longitudinal slots 65 are shown, lateral slots 66 in alternate plate 67 could be used, as could other perforations which provide controlled distribution of fluid to the fluid applicator 28. Fluid applicator 28 includes agitating material 44 retained in a support substrate or backing 68. The support substrate can be flexible or rigid and has sufficient structural integrity to retain the agitating material therein during use. A satisfactory fluid applicator is a piece of indoor-outdoor carpet, such as artificial turf, having flat grass simulating bristles as the agitating material 44 and the normal indoor-outdoor carpet backing as the support substrate 68. The agitating material is trimmed to provide a flange of backing or support substrate 68 forming a mounting flange which is secured to disk 34 by retaining ring 69 with screws 46 passing therethrough into disk 34. If desired, a piece of foam or sponge material 70 can be positioned in reservoir space 41 to help more evenly distribute the cleaning fluid over the distribution plate 64 or 67. With indoor-outdoor carpet, such as artificial turf, the backing material is generally water proof so perforations 42, FIG. 5, are provided through the backing 68, as previously indicated, to allow the cleaning fluid to flow from the reservoir area through the backing into the agitation material 44. While artificial turf is indicated as the fluid applicator in FIG. 7, various other materials, such as absorbent pad material 70 with a backing material 68 in FIG. 8 or bristle material 71 with a backing material 68 in FIG. 9, can be used. Disk 34 will also generally have a top disk plate 63 secured to the top thereof.

As the cleaning fluid is distributed throughout the fluid applicator, cleaning fluid then contacts and is transferred to the flooring surface. The flooring surface can typically be a carpet, although other materials can also be cleaned using the devices of the present invention. Non-limiting examples of flooring surfaces can include carpet, tile, concrete, slate, wood, and the like. Referring again to FIG. 2, the rotary cleaning head 22 can rotate clockwise or, as shown by arrow 35, counterclockwise. The vacuum members 30 are located such that during each pass, a substantial portion of the cleaning fluid transferred to the flooring surface by the fluid applicator 28 is substantially immediately removed by the vacuum member 30. FIG. 5 illustrates a vacuum member 30 having a slotted vacuum opening 31. Fluid and debris enter the slotted opening 31 and are sucked through opening 31 into vacuum chamber 48, through vacuum passage 49, and into the central vacuum chamber 50 within the rotary cleaning head. This is then further drawn through vacuum hose 51 to vacuum outlet 20. The vacuum member 30 can include a curved contact surface 30*a*, as shown in FIG. 5, which includes a vacuum opening in the form of vacuum slot 31 with a forward slot edge 32 and a rear slot edge 33 such that the forward edge 32 is raised above the rear edge 33. This configuration can increase the debris and fluid removal by a scooping action which supplements the vacuum. This configuration can be accomplished by curving the lower surface 30*a* of vacuum member 30 which contacts the flooring surface and offsetting slot 31 from the center of the curved lower surface of vacuum member 30, as shown in FIG. 5. Optionally, the vacuum member can be tilted at a slight angle, e.g. about 2° to about 25°. In another optional embodiment of the present invention, the lower surface of the vacuum member 30 can preferably be oriented below a plane formed by ends of the agitating material 44. Orienting the vacuum member 30 below the agitating material allows the vacuum member to penetrate or press into the flooring material a further distance than otherwise would be allowed by orienting the agitating material at a lower level. Typically, this height difference can range from about 0.5 mm to about 2 mm although other distances may be suitable depending on the stiffness of the agitating material and particular carpet being cleaned. However, depending on the stiffness of the agitating material compared to the flooring material, the offset distance between the vacuum member and the ends of the agitating material can be varied to achieve the desired balance of rigorous agitating and vacuum performance.

During operation, the rotary cleaning device including a rotary cleaning head in accordance with the present invention provides a method of cleaning flooring materials, such as carpet, with improved debris recovery and reduced residual fluid. The flush pad extractors of the present invention allow for passively applying a cleaning fluid to the surface of the flooring material in a rotational pass using the fluid applicators as described herein. Further, at least a portion of the cleaning fluid can be immediately removed during the same rotational pass using a vacuum member oriented behind the fluid applicator. By placing these members in a rotational arrangement, the residence time of cleaning fluid on a surface can be dramatically reduced. For carpet, this reduces the flow of fluid from the upper portion of the carpet down into the lower portion of the carpet where it is difficult to remove by vacuum and needs an extended drying period to evaporate. Further, the scrubbing action of the fluid applicators and any optional additional scrubbers or agitators can provide aggressive removal of solid caked materials, soils, or other debris which often does not respond to conventional treatments.

Orienting a plurality of flush pad extractors in a rotating configuration allows for substantial increase in agitation of the carpet which has been wetted by the fluid applicator. In terms of rotations per minute (rpm), the rotational passes of each flush pad extractor with fluid applicator can be repeated at a rate from about 100 rpm to about 180 rpm. Handheld and non-rotary machines are incapable of providing similar agitation results, e.g., a five flush pad extractor rotary head at 150 rpm results in 650 cleaning cycles per minute. This typically results in a lag time between deposition and pickup of cleaning fluid of less than about 0.5 second, and typically less than about 0.1 second. Further, the lag time between each cleaning cycle of a flush pad extractor, e.g. fluid applicator plus vacuum member, is less than about 0.8 seconds, and preferably less than about 0.5 seconds. Further, despite the high number of cleaning passes, each pass leaves very little residual fluid such that upon completion, drying times are substantially reduced. For example, in most cases drying times can be less than about 2 hours and often less than about 1 hour. At least one prominent reason for this improved drying time is the reduced depth of penetration of the fluid. Specifically, with carpet as the flooring material, the rotating flush pad extractors allow for significant penetration into the upper portion of the carpet pile without penetrating so far as to make removal difficult. For example, under typical operating conditions, the cleaning fluid substantially penetrates no more than about ⅓ to about ½ the depth of the carpet piling. Thus, more than merely the surface of the carpet is cleaned. Further, the vast majority of soil and debris is typically located within the upper half of carpet piling so that good cleaning of the carpet takes place.

In addition to reduced drying times, a substantial improvement in cleaning effectiveness can also be realized using the devices of the present invention. The agitation provided by the fluid applicators and optional additional scrubbing brushes is augmented by the weight of the entire device. Specifically, in most embodiments of the present invention, the rotary cleaning head can be the only portion of the device which contacts the flooring surface. Therefore, the operator does not need to apply any extra weight to the machine but rather dominantly can rely on the weight of the device to provide sufficient force to the agitating materials.

In the illustrated embodiment, the vacuum member vacuum slot 31 is operatively connected to central vacuum chamber 50 in the body of the rotary cleaning device 12. Typically, although not required, the vacuum chamber 50 can be connected through vacuum hose 51 and vacuum outlet 20 to a vacuum source, such as a truck-mounted system or other vacuum system. In one aspect of the invention, the distance from the vacuum source, such as the truck-mounted system, can be extended over conventional systems. This extended distance is generally attributed to a lower vacuum necessary to remove fluid because the cleaning fluid is not as deeply penetrated into carpet.

Alternatively, the vacuum source, cleaning fluid source, and/or fluid recovery storage can be integrated into a portable unit which is operatively connected to the rotary cleaning device. For example, a lightweight vacuum source and storage container can be fitted with straps to form a backpack to increase portability. In this way, the distance between a vehicle and the flooring to be cleaned is substantially unimportant. Alternatively, the vacuum source, cleaning fluid source, and/or fluid recovery container can be placed on a wheeled unit which can be pulled in the vicinity of the operating rotary cleaning device. In each case the only restriction on portability would be the distance to an electrical outlet.

Figure 11:
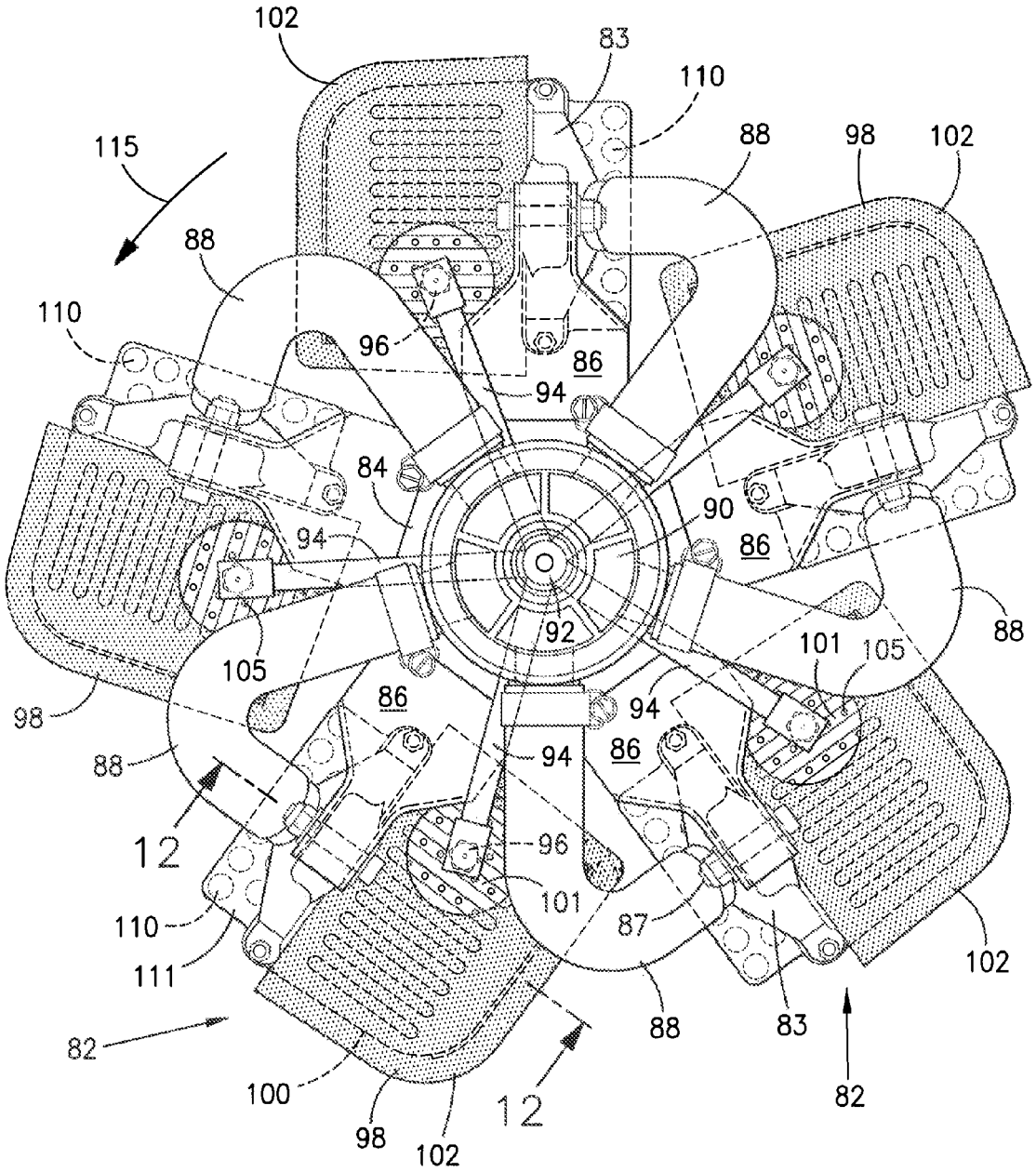
FIG. 11 is a top plan view of a rotary cleaning head taken on the line 11-11 of FIG. 10, showing only the rotary cleaning head.

Although the rotary cleaning head 22 is shown in FIGS. 2 through 9 as a rotatable disk 34 such that the plurality of flush pad extractors 24 are mounted or attached to the bottom surface of the rotatable disk, other configurations can also be used. FIGS. 10-13 illustrate another alternative embodiment of a rotary cleaning device 72. In this embodiment, a motor 73 can be oriented above the housing member 74 with the motor coupled to a rotatable cleaning head 80 in any suitable manner to cause rotation of rotatable cleaning head 80 during operation of the device. A vacuum source is connected through vacuum connector 75 to vacuum tank and collector 76 with vacuum hose 77 extending to filter 78 with vacuum hose 79 extending from filter 78 through housing member 74 to connection with a central vacuum chamber 90 in central hub 84 of rotatable cleaning head 80. The rotatable cleaning head 80 includes a plurality of arms or extension members 86 each secured to and extending from the central hub 84 and supporting a flush pad extractor 82. Each flush pad extractor 82 includes a fluid applicator 98 and a vacuum member 112 with vacuum slot 113. Each vacuum member vacuum slot 113 is connected through a vacuum conduit 88 to central vacuum chamber 90 within the central hub 84. Similarly, a cleaning fluid supply line 91 is connected from a source of pressurized cleaning fluid to a central fluid distribution assembly 92 in central hub 84 where dedicated fluid lines 94 extending therefrom are configured to distribute cleaning fluid to the plurality of the flush pad extractors. Each fluid line 94 can terminate in a nozzle 96 supported above a respective fluid applicator 98. Nozzle 96 can be connected to the end of fluid line 94 through elbow connector 97. As best seen in FIGS. 11 and 12, each flush pad extractor 82 includes an extractor body 83 which is pivotally attached to an extension member 86 by a pivot pin 87. Each flush pad extractor can be independently spring loaded in order to provide a cushioning effect during operation and to provide smoother operation. The flush pad extractor 82 of this embodiment includes a kicker plate 100 secured to extractor body 83 which provides a rigid support for a fluid applicator 98 in the form of a cover 102 which is configured to allow the cover 102 to removably slip over the kicker plate 100. Kicker plate 100 includes slots 101 or other perforations therethrough, such as holes, mesh, or other openings, to allow passage of cleaning fluid therethrough. The fluid applicator can be formed of any suitable agitating material. However, the material can preferably be a non-absorbent agitating pad, and the currently most preferred material is an artificial turf pad as previously described having agitating grass simulating fibers 103 held by and extending from a backing material 104. When an artificial turf material with waterproof backing is used, the fluid applicator will include perforations 105, FIG. 12, in the backing material 104 which holds the agitating material 103 to allow cleaning fluid to pass through the backing material 104 from the upper surface of the backing material into the agitating material 103, from where it is transferred to the flooring material to be cleaned.

Also, as illustrated in FIGS. 11 and 12, cover 102 includes an opening 108 in the top thereof to expose a top portion of kicker plate 100. Cleaning fluid nozzle 96 is supported above the fluid applicator and is positioned to direct a spray of cleaning fluid 109, FIG. 12, to the upper surface of kicker plate 100 through cover opening 108. The sprayed cleaning fluid 109 impacts the top of kicker plate 100 to be distributed through the slots 101 in the kicker plate and perforations 105 through backing material 104 to access the agitating material 103 proximate the flooring surface. The nozzles 96 can be oriented in any functional manner; however, in one aspect of the invention, the nozzles 96 are oriented to spray cleaning fluid on an inner exposed portion of the kicker plate such that centrifugal force during rotation of the cleaning head 72 can readily force fluid radially outwardly toward outer portions of the kicker plate and fluid applicator. Kicker plate 100 can optionally be contoured upwardly toward its distal end 114 in order to reduce the possibility of damaging walls or furniture during operation. In one aspect, the kicker plate can be ¼" stainless steel, although other materials such as high strength plastics or non-corroding metals can be useful. As mentioned previously, additional optional agitating brushes 110 extending from support 111 secured to extractor body 83 can be included as part of the flush pad extractor which provide further aggressive cleaning and disruption of soil and debris. The optional agitating brushes 110 can be oriented subsequent to the fluid applicator and vacuum member 112 with respect to the direction of motion during operation as indicated by arrow 115. The vacuum member 112 is secured to extractor body 83 so that vacuum slot 113 communicates with extractor body vacuum passage 116 extending through extractor body 83 to connect vacuum slot 113 to vacuum conduit 88.

The rotary cleaning head devices of the present invention can be incorporated into a rotary device as discussed herein. Several of the components of this device can be provided as a replacement or retrofit kit. Thus, as parts wear out or are damaged, replacement fluid applicators, non-absorbent agitating pads, and/or vacuum members can be provided as a convenient kit.

Currently, the preferred non-absorbent agitating pad includes a perforated artificial turf pad. Artificial turf pads have demonstrated good agitating on a variety of floor coverings while also providing controlled delivery of cleaning fluid. Specifically, it appears that the spacing and shapes of the artificial tuft blades provides a degree of water retention which prevents localized dropping of excessive water and more evenly distributed water across the upper surface of a floor covering.

For some applications where excessive soiling of the carpet has occurred, additional optional agitating pads or bristle pads can be included on the bottom surface of the rotating cleaning head.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A rotary cleaning device, comprising a plurality of flush pad extractors oriented generally circumferentially about a common rotation axis, said flush pad extractors including a fluid applicator and a vacuum member oriented behind the fluid applicator such that during operation the fluid applicator contacts a surface to be cleaned prior to contact by the vacuum member, and a pressurized fluid reservoir to supply fluid to the fluid applicator, said fluid applicator providing passive delivery of fluid to the surface to be cleaned, wherein said fluid is distributed from a central distribution channel oriented about the common rotation axis to a top side of said fluid applicator, and wherein the vacuum member includes a vacuum opening which includes a forward edge and a rear edge such that the forward edge is raised above the rear edge.

2. The device of claim 1, wherein each flush pad extractor is attached to a common central hub using separate extension members.

3. The device of claim 2, wherein the vacuum member is oriented immediately behind the fluid applicator.

4. The device of claim 1, wherein each flush pad extractor is attached to a bottom surface of a rotating disk.

5. The device of claim 1, wherein at least one of the flush pad extractors further comprises an agitating brush oriented immediately after the vacuum member.

6. The device of claim 1, wherein the fluid applicator includes a non-absorbent agitating pad.

7. The device of claim 6, wherein the non-absorbent agitating pad includes a perforated artificial turf.

8. The device of claim 6, wherein the fluid applicator further comprises a kicker plate for receiving and holding the non-absorbent agitating pad, said kicker plate having a distal edge which is contoured upward.

9. The device of claim 1, further comprising a vacuum source operatively connected to each vacuum member.

10. The device of claim 1, further comprising a cleaning fluid source operatively connected to each fluid applicator.

11. The device of claim 1, further comprising a motor operatively connected to the common rotation axis and configured to rotate the plurality of flush pad extractor about the common rotation axis.

12. The device of claim 1, additionally including means for supplying fluid to the fluid applicator during operation of the device.

13. The device of claim 12, wherein the means for supplying fluid to the fluid applicator during operation of the device includes a nozzle oriented to spray fluid into the fluid applicator.

14. The device of claim 12, wherein the means for supplying fluid to the fluid applicator during operation of the device includes a fluid reservoir area above the fluid applicator to supply fluid to the fluid applicator.

15. The device of claim 1, wherein the fluid applicators comprise regions separated by the vacuum members.

16. A rotary cleaning head retrofit kit, comprising:

a) a plurality of fluid applicators which include non-absorbent agitating pads, said plurality of fluid applicators providing for passive delivery of fluid to a surface to be cleaned, wherein said fluid is distributed from a central distribution area to a top side of each of said plurality of fluid applicators; and b) a plurality of vacuum members.

17. The kit of claim 16, wherein the non-absorbent agitating pad comprises a perforated artificial turf.

18. The kit of claim 16, further comprising a plurality of bristle pads.

19. The device of claim 1, wherein a lower surface of the vacuum member is located below the fluid applicator.

20. A rotary cleaning device, comprising a plurality of flush pad extractors oriented generally circumferentially about a common rotation axis, said flush pad extractors including a fluid applicator and a vacuum member oriented behind the fluid applicator such that during operation the fluid applicator contacts a surface to be cleaned prior to contact by the vacuum member, and a pressurized fluid reservoir to supply fluid to the fluid applicator, said fluid applicator providing passive delivery of fluid to the surface to be cleaned, wherein said fluid is distributed from a central distribution channel oriented about the common rotation axis to a top side of said fluid applicator, and wherein the fluid applicator includes a non-absorbent agitating pad and a kicker plate for receiving and holding the non-absorbent agitating pad, said kicker plate having a distal edge which is contoured upward.

* * * * *